US005429264A

United States Patent [19]

Hollander et al.

[11] Patent Number: 5,429,264

[45] Date of Patent: Jul. 4, 1995

[54] INSULATED CONTAINER FOR PACKAGING REFRIGERATED GOODS

[75] Inventors: David S. Hollander, Brooklyn; Mark S. Rubenstein, Long Beach, both of N.Y.

[73] Assignee: Transtech Service Network, Inc., Rosedale, N.Y.

[21] Appl. No.: 97,770

[22] Filed: Jul. 26, 1993

Related U.S. Application Data

[63] Continuation-in-part of Ser. No. 483,389, Feb. 28, 1990, abandoned, Ser. No. 589,458, Sep. 11, 1990, abandoned, and Ser. No. 604,144, Oct. 26, 1990, Pat. No. 5,230,941.

[51] Int. Cl.[6] ..... B65D 5/60; B65D 5/50

[52] U.S. Cl. ..... 220/408; 220/410; 220/441; 229/143; 229/3.5 MF

[58] Field of Search ..... 229/143, 149, 3.5 R, 229/3.5 MF; 220/403, 408, 410, 441, 450, 452, 467, 468, 902; 206/545

[56] References Cited

U.S. PATENT DOCUMENTS

| | | | |
|---|---|---|---|
| 306,532 | 10/1884 | Schmidt | 229/143 |
| 2,682,988 | 7/1954 | Rosen et al. | 220/410 |
| 2,815,795 | 12/1957 | Vander Poel . | |
| 3,024,939 | 3/1962 | Kantor | 220/468 |
| 3,516,596 | 6/1970 | Madden et al. | 220/410 |
| 3,642,550 | 2/1972 | Doll | 229/3.5 R |
| 4,236,740 | 12/1980 | Sorenson et al. | 229/143 |
| 4,434,890 | 3/1984 | Sieck et al. | 229/3.5 MF |
| 4,592,914 | 6/1986 | Kuchenbecker | 220/410 |
| 4,886,164 | 12/1989 | Stein et al. | 220/403 |
| 4,928,847 | 5/1990 | Hollander et al. | 220/408 |
| 5,000,372 | 3/1991 | Hollander et al. | 229/23 R |
| 5,009,326 | 4/1991 | Reaves et al. | 220/410 |
| 5,100,016 | 3/1992 | Wischusen, III | 220/410 |
| 5,102,004 | 4/1992 | Hollander et al. | 220/408 |
| 5,111,957 | 5/1992 | Hollander et al. | 220/408 |
| 5,230,941 | 7/1993 | Hollander et al. | 428/116 |
| 5,289,970 | 3/1994 | McClure | 229/143 |

OTHER PUBLICATIONS

"Honeycombed Package Security" *Air Transportation* pp. 27–28, Mar. 1965.

*Primary Examiner*—Gary E. Elkins

*Attorney, Agent, or Firm*—Kane, Dalsimer, Sullivan, Kurucz, Levy, Eisele and Richard

[57] ABSTRACT

An insulated container has an outer box having a two part top having tabs that are received in slots in the sides of the box for securing the top in a closed position. Insulated panels are within the box along the top and the sides. An insulated bottom panel is within the box and has downwardly depending peripheral arms that define a space. A plastic sheet encapsulates the bottom panel and a plastic bag is disposed about the encapsulated bottom panel so that the space is an ice melt collection reservoir.

10 Claims, 8 Drawing Sheets

INSULATED CONTAINER FOR PACKAGING REFRIGERATED GOODS

BACKGROUND OF THE INVENTION

This application is a continuation-in-part of U.S. patent applications Ser. Nos. 483,389 filed Feb. 28, 1990 abandoned, 589,458 filed Sep. 11, 1990 abandoned, and 604,144 filed Oct. 26, 1990 now U.S. Pat. No. 5,230,941.

This application is related to commonly owned U.S. Pat. Nos. 4,928,847 dated May 29, 1990, 5,000,372 dated Mar. 19, 1991, 5,102,004 dated Apr. 7, 1992, and 5,111,957 dated May 12, 1992 a. Field of the Invention

The present invention relates to packaging perishable goods and other temperature sensitive products, and, particularly, for packaging goods such as salmon, or other fresh or frozen seafood species, outside of refrigeration for extended periods of time.

b. Description of the Prior Art

U.S. Pat. Nos. 4,928,847, 5,000,372 and 5,111,957 disclose acceptable and commercial packaging for perishable goods and other temperature sensitive products utilizing foil laminated panels.

Pending patent application Ser. No. 604,144 discloses an improved insulated panel for insulated containers in which honeycomb kraft paper core having on each side kraft paper facings laminated on both sides with aluminum foil.

OBJECTIVE AND SUMMARY OF THE INVENTION

The principal object of the present application is to provide an improved insulated container for shipping fresh salmon, or other fresh or frozen seafood species, outside of refrigeration for extended periods of time.

Other objects and advantages will become apparent from the following detailed description which is to be taken in conjunction with the accompanying drawings.

DETAILED DESCRIPTION OF THE PREFERRED EMBODIMENTS

Figure 1:
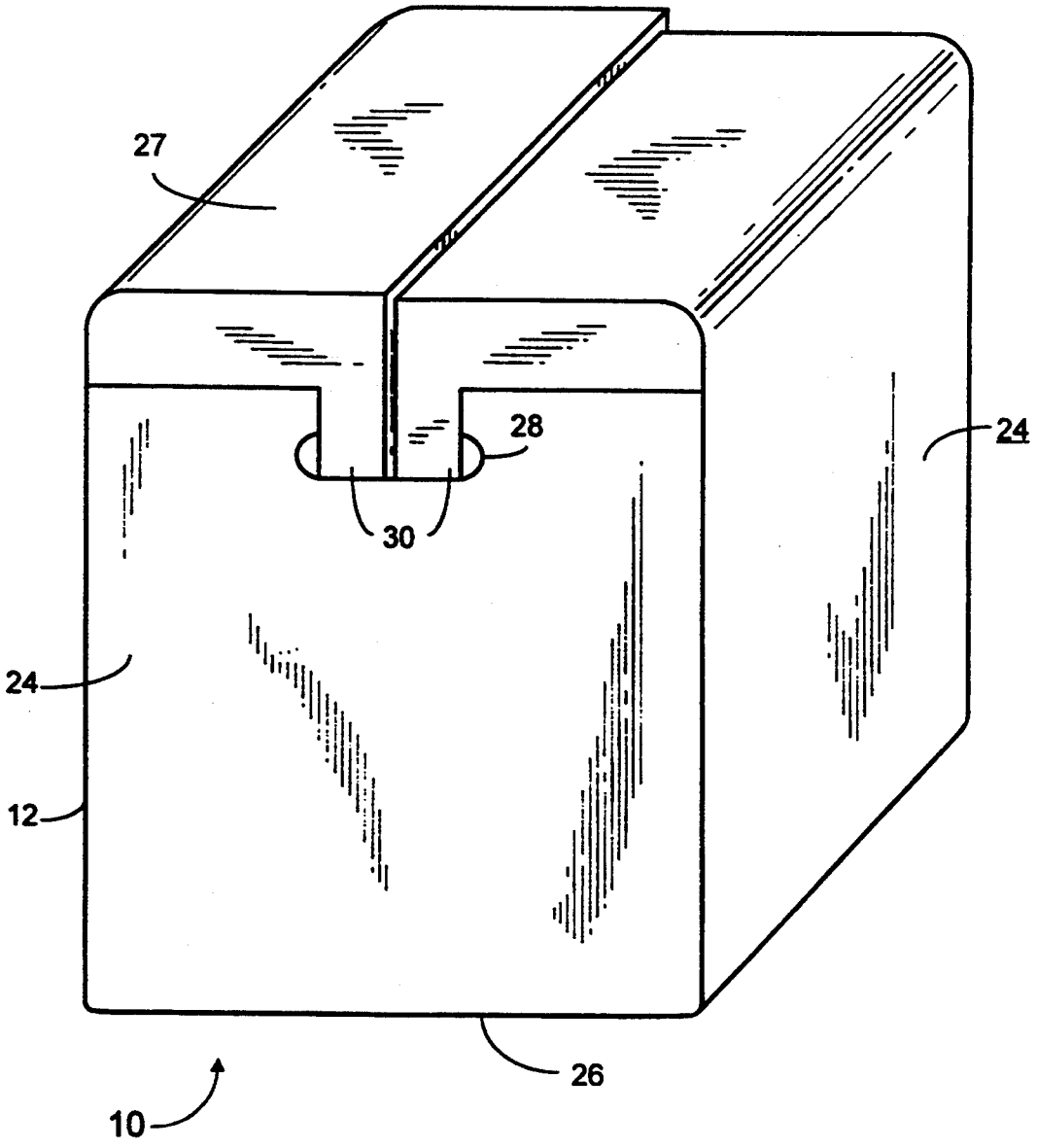
FIG. 1 is a front perspective view of the insulated container incorporating the teachings of the present invention.

In the drawings, the insulated container (10) of this invention includes an outer corrugated cardboard box (12), inner insulated perimeter side panel, (14), insulated top lid panel (16), insulated bottom panel (18), bottom panel encapsulating heat sealed polyethylene sheet (20), and polyethylene bag 22.

The insulated panels comprise two laminated kraft facings sandwiching a honeycomb kraft paper core. The kraft paper facings are laminated on each of its two sides with aluminum foil with emissivity values ideally less than or equal to 0.05. The aluminum laminated facing, when bonded directly to the honeycomb core on both sides, creates a sandwich-type structure.

The honeycomb panel structure replicates the insulating system of a thermos, in that a still airspace is enclosed by reflective surfaces. By limiting a core medium to still air, heat transfer by conduction is severely minimized. In addition to providing the support structure to create a cavity between reflective surfaces, the honeycomb cells divide the airspace into smaller cells and minimize heat transfer by convection as well. Since the balance of heat transfer could only occur by radiative means through this environment, the inner wall surfaces are laminated with an "ultra-low" emissivity aluminum foil, the only barrier that can severely minimize long wave radiation transfer.

The outer corrugated cardboard box (12) includes sides (24), bottom (26) and two part hinged top (27). The top includes self-locking slots (28) and tabs (30) to avoid the necessity of taping the top in order to secure the top in a closed position.

Figure 6:
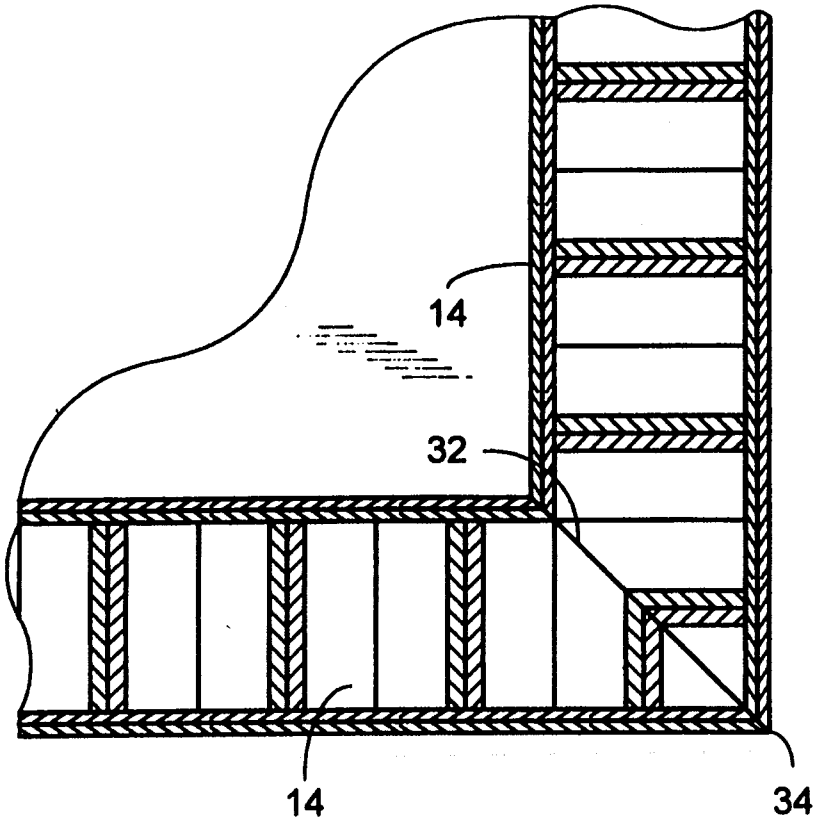
FIG. 6 is an enlarged fragmentary top plan view showing a section of a corner of the side panels.
Figure 7:
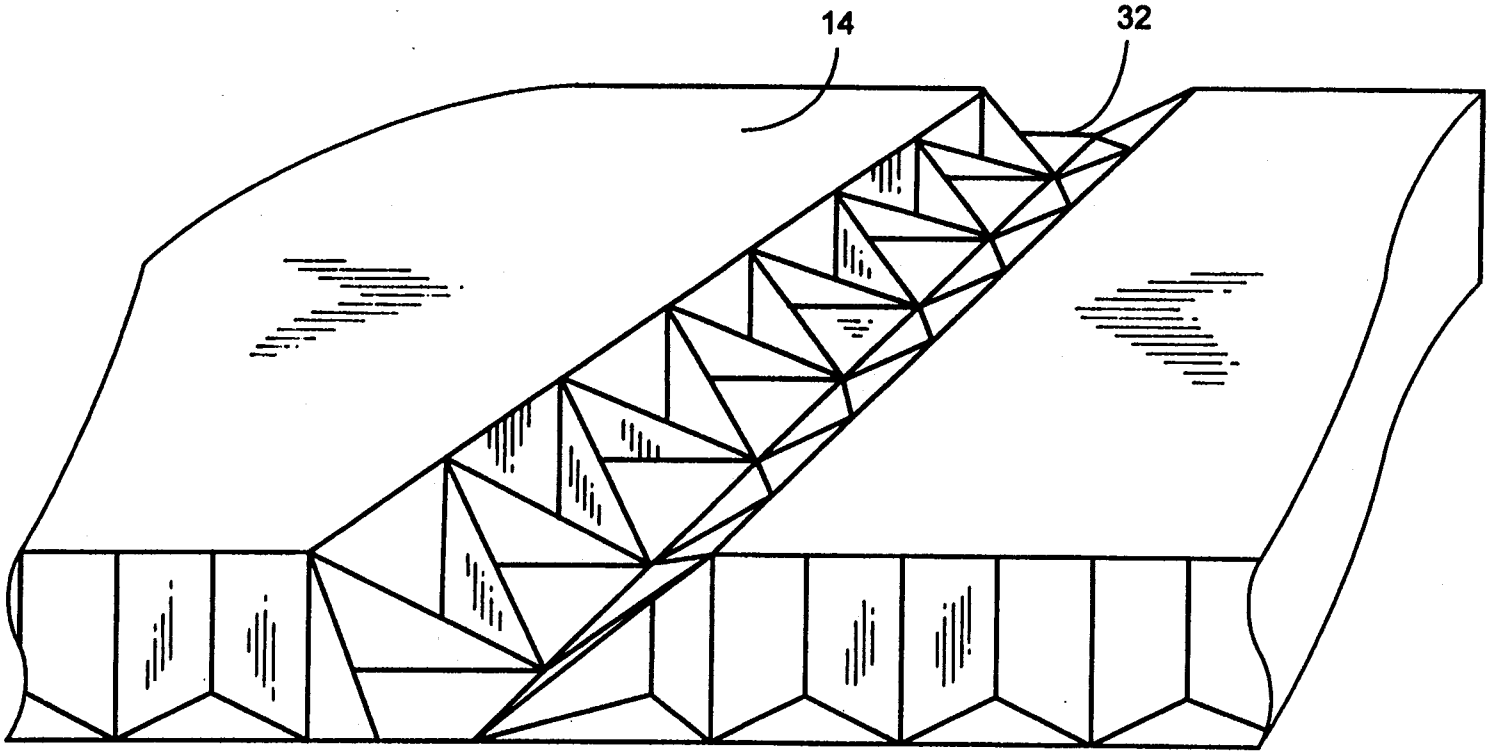
FIG. 7 is an enlarged fragmentary perspective view showing the V-shaped grooves in the side panel that define a corner.
Figure 8:
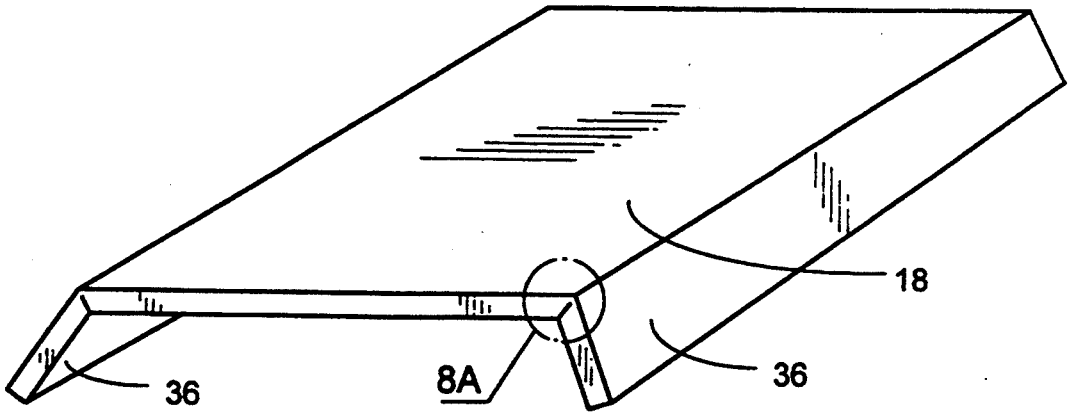
FIG. 8 is a perspective view of the bottom panel.
Figure 8A:
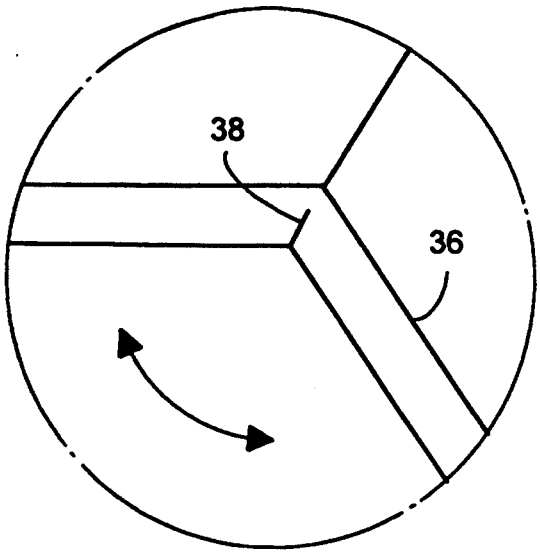

The perimeter side panel (14) is constructed from a single panel with three V-shaped grooves 32 (see FIG. 7). The V-shaped grooves facilitate the side enclosure; and accurate placement of the three grooves along the length of the panel allows the panel to contour the inside of the outer box (12) by accurately locating the corners (34) (see FIG. 6) which may also have a suitable glue applied to secure the adjoining panel faces.

Figure 2:
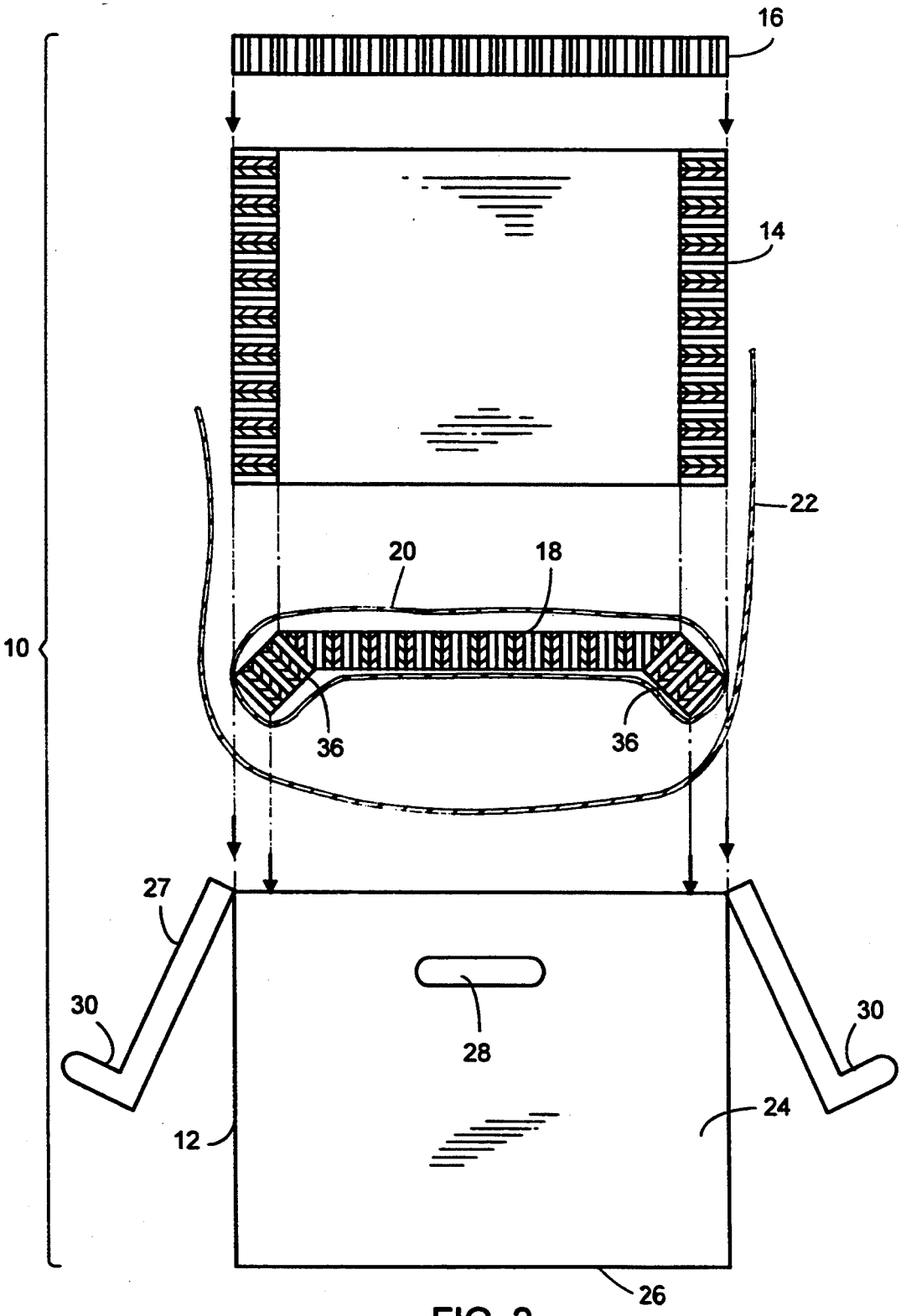
FIG. 2 is an exploded elevational view of the components of the insulated container; with certain parts broken away, removed and sectioned.
Figure 3:
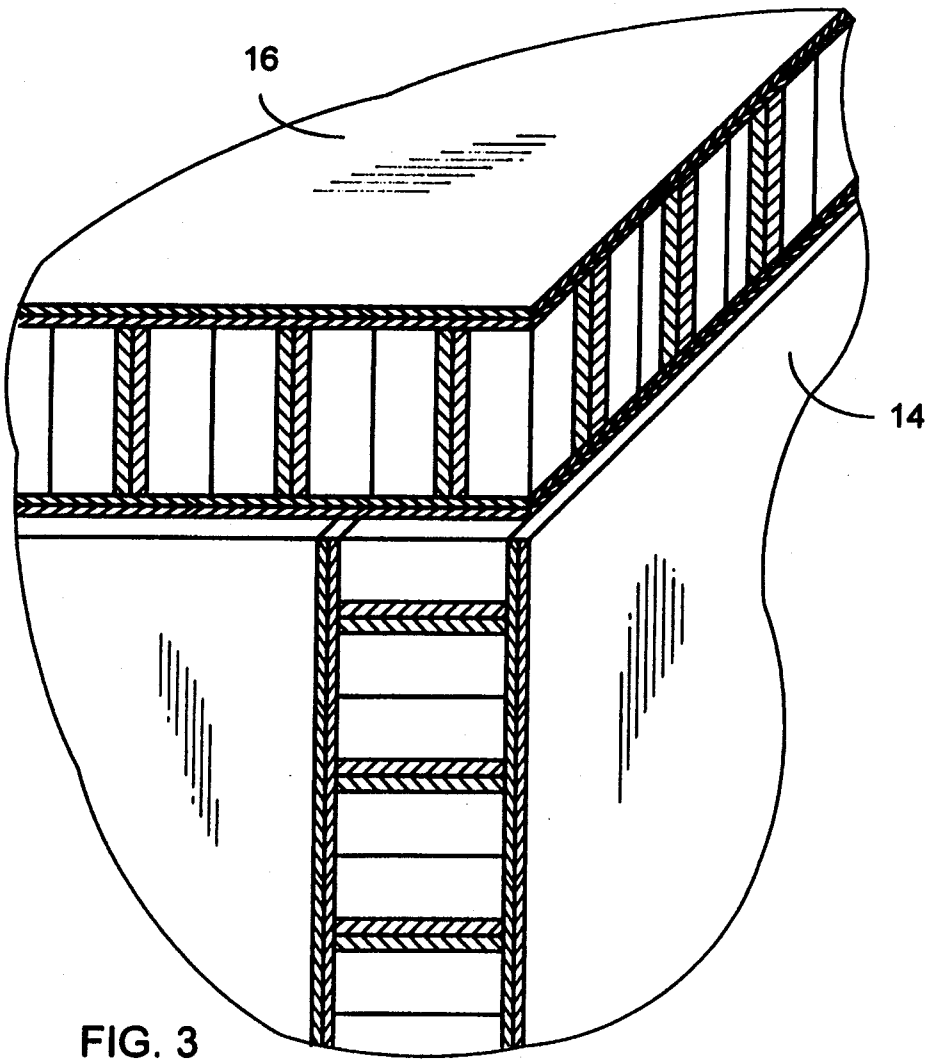
FIG. 3 is an enlarged fragmentary sectional view of an upper corner of the inner panels.
Figure 4:
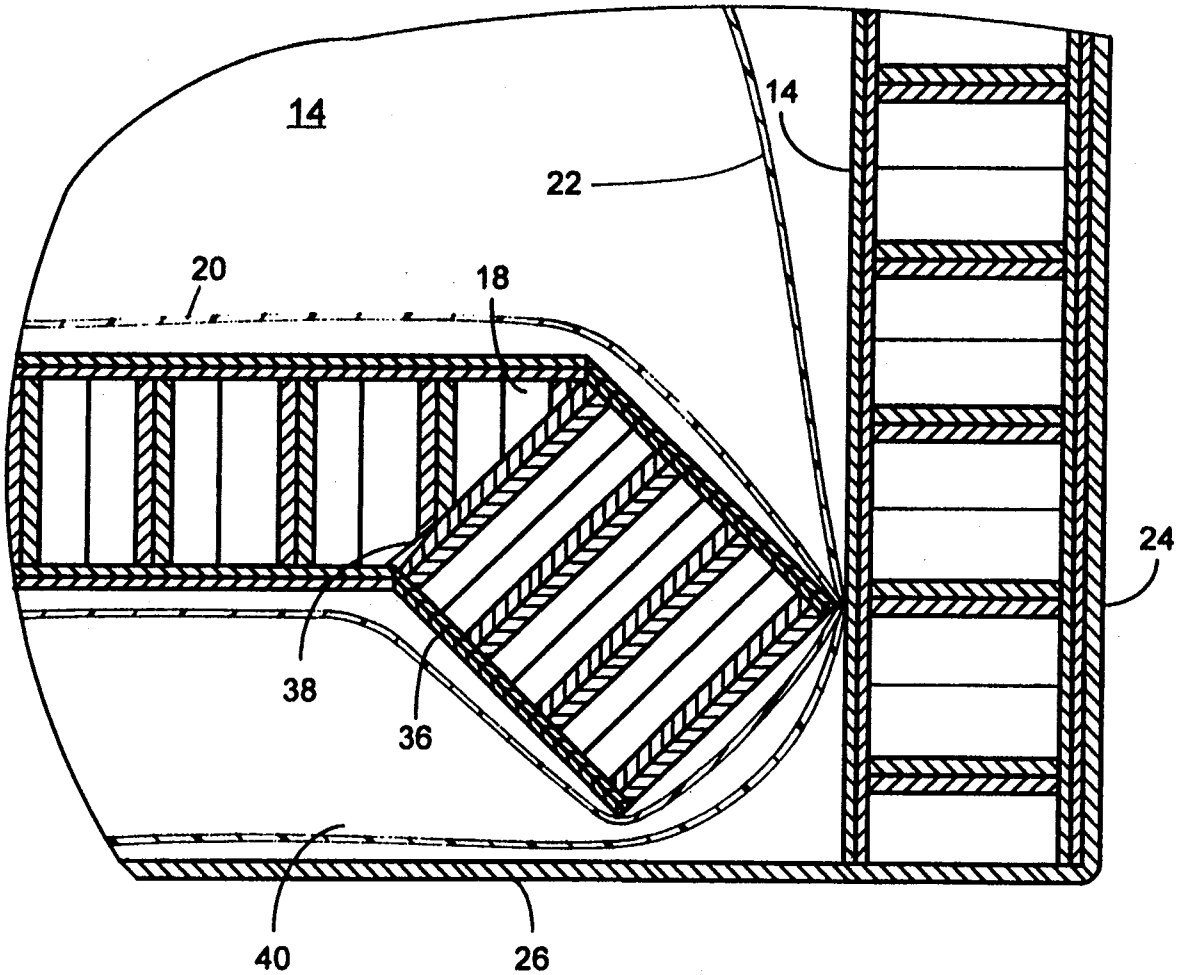
FIG. 4 is an enlarged fragmentary sectional view of a lower corner of the container.
Figure 5:
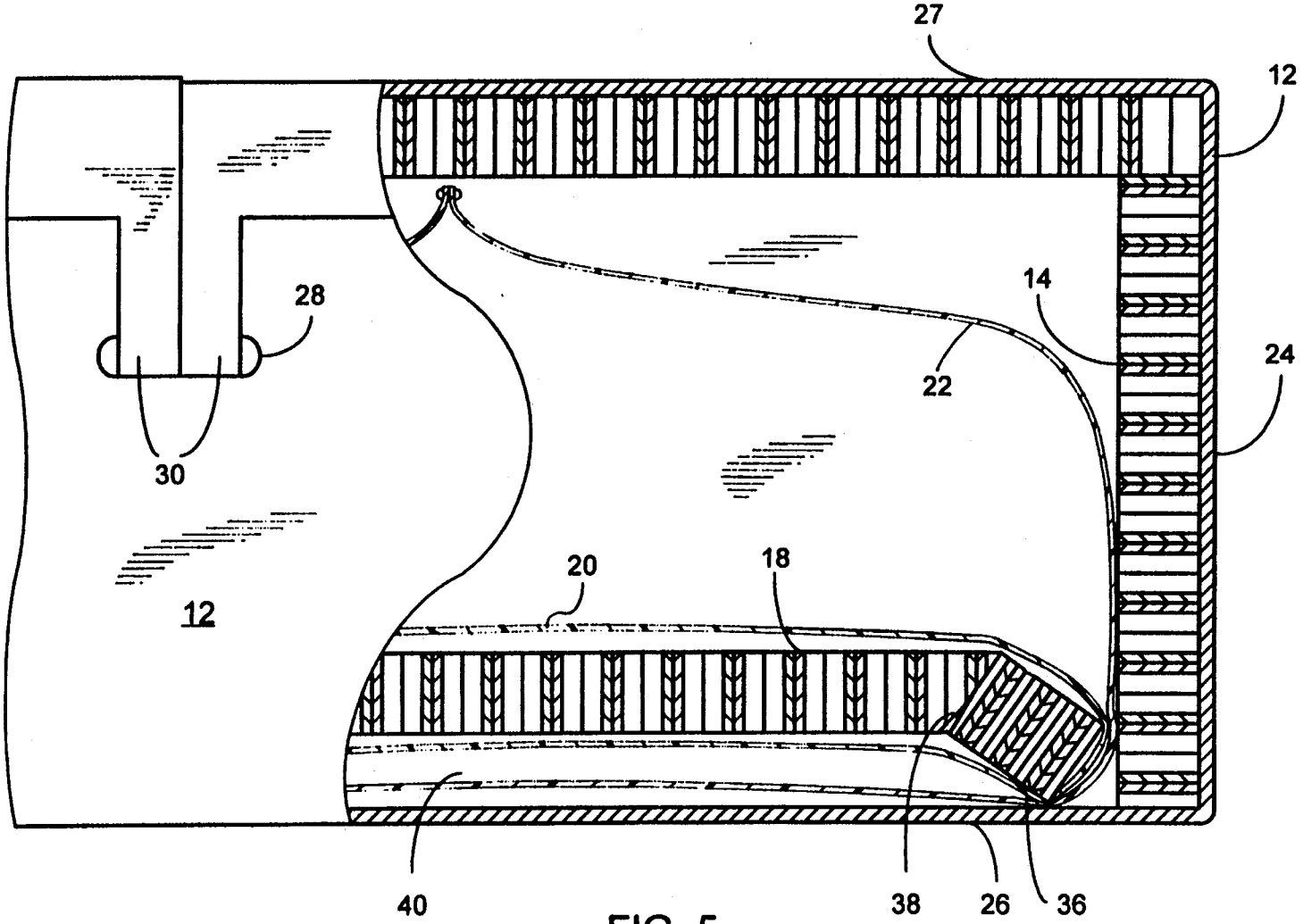
FIG. 5 is a front elevational view of the container with certain parts broken away, removed and sectioned.

The top lid panel (16) may simply be a single member adapted to rest on top of the side panel (14) as shown in FIGS. 2,3, and 5.

The bottom panel (18) is also a single panel having downwardly and outwardly projecting arms (36) facilitated by 30 degree V-shaped slits (38) partially into the panel. By folding these arms (36) downwardly as shown the bottom panel now becomes a drain board for any melting ice and creates a cavity (40) which serves as a reservoir for water seepage. As is apparent, the bottom panel (18) fits snugly within the perimeter side panel (14) and rests on the bottom (26) of the box (12) and within bag (22).

The sheet (20) is heat sealed above the bottom panel (18) and insures the complete encapsulation thereof; and sheet (20) protects the paper of bottom panel (20) from ice melt. Similarly, the bag (22) in put under the box (12) to protect paper from ice melt. As shown the bag (22) has encapsulated bottom panel (18) thereof and cooperates in defining water collection reservoir (40).

The V-shaped grooves (32) and V-shaped slit (38) as stated may be sprayed with a light tack adhesive to assist in partial assembly outside the box (12). This allows for easier handling when the side and bottom panels are inserted in the box. When the panel is folded along the V-shaped grooves and slits they will remain fixed so that the bend is maintained without applied pressure.

In a preferred embodiment, paper used to make the honeycomb core will be processed to have specifications that will ensure its water resistance. For example, 26# (lb.) or 30.7# wet strength paper (either 30% or 50% wet strength reinforced with the chemical additive Kymene) formulated and sold commercially as TK-1 by Cascades Paper of Quebec, Canada. Other treated paper with a commercially acceptable alternative additive suitable to accomplish the same wet strength reinforcement properties may also be employed. Wet strength reinforcement is an advantageous characteristic of the paper used to make the kraftpaper honeycomb core medium where the packages containing fresh or frozen perishable commodities are used with wet ice or dry ice as refrigerants, or are placed in refrigeration or freezer facilities for extended periods of time. The wet strength properties enable the paper to resist the saturation by water from melting ice coming in direct contact with the paper, or to resist the moisture generated by dry ice as it sublimes, or the moisture created as a result of extended periods of refrigeration. Non-rosin based, biodegradable additives may be substituted for Kymene and like rosin additives to achieve the wet strength properties in the package to ensure the acceptability of the package for recycling after use. Where fresh seafood is shipped using reusable ice (gel packs) as a refrigerant, wet strength additives may not be necessary to be added to the paper used to make the honeycomb core.

The top, side and bottom insulated panels are preferably the double-sided foil panels described in application Ser. No. 604,144 using a double sided foil facing which is bonded to each side of the honeycomb core. Each insulated panel is a thermal insulative structure comprising a pair of upper and lower metallic foil layers, adjacent an interposed upper and lower paper sheet layer between and laminated to the foil layers of each pair, said upper and lower layers being separated by a honeycomb barrier comprising a series of closed polygonal compartments separated by paper walls perpendicular to said upper and lower paper sheet and foil layers, said polygonal compartments being hollow so as to maintain airspaces therewithin, the honeycomb barrier functioning to ensure the structural integrity of the air space defined by the honeycomb barrier and retard radiant heat irrespective of heat flow direction to thereby reduce thermal transfer and assuring thermal efficiency of the air space defined by the honeycomb insulated barrier by reducing the air in the space to still air so that heat transfer by conduction is minimized, the polygonal compartments functioning to minimize heat transfer by convection, the foil layers being reflective and possessing low emissivity to minimize heat transfer by radiation. The following specification applies to a successful facing embodiment of the invention:

0.0003 inch gauge (high reflectivity, low emissivity) aluminum foil laminated to 26 or 33# kraft paper. 8 lb low density polyethylene is used to bond the foil to each side of the kraftpaper medium.

The specifications of an alternate facing material is as follows:

3 mil aluminized polyester film (PET) laminated to each side of 6 mil paper or equivalent.

A successful embodiment of the present invention may be designed to hold up to 50 lbs of mass of perishables but it should be understood that this invention is not limited to weight, volume or dimensions.

Thus, the several aforementioned objects and advantages are most effectively attained. Although a single somewhat preferred embodiment has been disclosed and described in detail herein, it should be understood that this invention is in no sense limited thereby and its scope is to be determined by that of the appended claims.

We claim:

1. An insulated container for perishables comprising:

a box having sides, a bottom and a top;

insulated side panels within the box extending along the sides of the box;

an insulated top panel within the box extending along the top of the box;

an insulated bottom panel within the box located at the bottom of the box, the bottom panel having a top having a periphery and a pair of opposed arms extending downwardly toward the bottom of the box to thereby form a cavity between the bottom panel top, arms and box bottom.

2. The invention in accordance with claim 1 wherein each insulated panel is a thermal insulative structure comprising:

upper an lower reflective means and an interposed insulated honeycomb barrier medium defining an insulating air space of a predetermined structural integrity and including air, at least one of the reflective means comprising a paper sheet layer and upper and lower metallic foil layers with the paper sheet layer interposed between the foil layers, each reflective means comprising upper and lower metallic foil layers laminated to an interposed paper sheet layer thereby creating a thermos effect, the medium comprising a series of hollow compartments separated by paper walls, the honeycomb barrier medium functioning to ensure the structural integrity of the air space defined by the honeycomb barrier medium and retard radiant heat irrespective of heat flow direction to thereby reduce thermal transfer and assuring thermal efficiency of the air space defined by the honeycomb barrier medium by reducing the air in the space to still air so that heat transfer by conduction is minimized, the insulated barrier medium functioning to minimize heat transfer by convection, the foil layers being reflective and possessing low emissivity to minimize heat transfer by radiation.

3. The invention in accordance with claim 1 wherein each insulated panel is a thermal insulative structure comprising a pair of upper and lower metallic foil layers, adjacent an interposed upper and lower paper sheet layer between and laminated to the foil layers of each pair, said upper and lower layers being separated by a honeycomb barrier comprising a series of closed polygonal compartments separated by paper walls perpendicular to said upper and lower paper sheet and foil layers, said polygonal compartments being hollow so as to maintain airspaces therewithin, the honeycomb barrier functioning to ensure the structural integrity of the air space defined by the honeycomb barrier and retard radiant heat irrespective of heat flow direction to thereby reduce thermal transfer and assuring thermal efficiency of the air space defined by the honeycomb barrier by reducing the air in the space to still air so that heat transfer by conduction is minimized, the polygonal compartments functioning to minimize heat transfer by convection, the foil layers being reflective and possessing low emissivity to minimize heat transfer by radiation.

4. The invention in accordance with claim 1 wherein a plastic sealed sheet encapsulates the bottom panel so that ice melt is directed into the cavity.

5. The invention in accordance with claim 4, wherein a plastic bag for containing the perishables is within the box and is disposed about the encapsulated bottom panel, whereby the cavity is an ice melt collection reservoir that isolates the ice melt from the panels and box.

6. The invention in accordance with claim 1 wherein each insulated panel is a thermal insulative structure comprising a pair of upper and lower metallic foil layers, adjacent an interposed upper and lower paper sheet layer between and laminated to the foil layers of each pair, said upper and lower layers being separated by a honeycomb insulated barrier having an air space with air comprising a series of closed polygonal compartments separated by paper walls perpendicular to said upper and lower paper sheet and foil layers, said polygonal compartments being hollow so as to maintain airspaces therewithin, the honeycomb barrier functioning to ensure the structural integrity of the air space defined by the honeycomb barrier and retard radiant heat irrespective of heat flow direction to thereby reduce thermal transfer and assuring thermal efficiency of the air space defined by the honeycomb barrier by reducing the air in the space to still air so that heat transfer by condition is minimized, the polygonal compartments functioning to minimize heat transfer by convection, the foil layers being reflective and possessing low emissivity to minimize heat transfer by radiation; a plastic sealed sheet encapsulates the bottom panel so that ice melt is directed into the cavity; a plastic bag for containing the perishables is within the box and is disposed above the encapsulated bottom panel, whereby the cavity is an ice melt collection cavity that isolates the ice melt from the panels and box.

7. The invention in accordance with claim 6 wherein the top of the box has two parts each having a distal free end and a proximal end hingedly connected to the sides, at least one slot in at least one of the sides spaced from the top, and at least one tab at the free end of each of the top parts inserted in the slot for releasably securing the top parts to the one of the sides; the box has four sides and a slot in an opposed pair of sides and the proximal ends of the top parts being hingedly connected to the other pair of opposed sides, the free ends of each top part having a pair of the tabs for insertion in the slots.

8. The invention in accordance with claim 1 wherein the top of the box having two parts each having a distal free end and a proximal end hingedly connected to the sides, at least one slot in at least one of the sides spaced from the top, and at least one tab at the free end of each of the top parts inserted in a slot for releasably securing the top parts to one of the sides; the box has four sides and a slot in an opposed pair of sides and the proximal ends of the top parts being hingedly connected to the other pair of opposed sides, the free ends of each top part having a pair of the tabs for insertion in the slots.

9. The invention in accordance with claim 1 wherein the juncture between the top and each of the opposed arms of the bottom panel being formed from a V-shaped slit and the arms being folded downwardly at each slit.

10. The invention in accordance with claim 9 wherein surfaces of the V-shaped slit have adhesive to assist in partial assembly of the bottom panel outside the box.

* * * * *